US006508907B1

(12) United States Patent
Lutz

(10) Patent No.: US 6,508,907 B1
(45) Date of Patent: Jan. 21, 2003

(54) CHIMNEY CROWN INSTALLATION SYSTEM

(76) Inventor: Monte Lutz, 2000 Industrial Ave., Sioux Falls, SD (US) 57104

( * ) Notice: Subject to any disclaimer, the term of this patent is extended or adjusted under 35 U.S.C. 154(b) by 0 days.

(21) Appl. No.: 09/567,943

(22) Filed: May 10, 2000

(51) Int. Cl.[7] ..... B28B 1/14; E04G 15/06; B29C 65/50; B29C 33/38

(52) U.S. Cl. ..... 156/304.3; 264/35; 264/152; 264/219; 249/17; 249/19; 249/188; 29/462; 29/464; 29/520.1; 52/218; 52/244; 52/301; 156/304.5

(58) Field of Search ..... 264/35, 152, 219, 264/333; 249/17, 19, 188; 52/218, 244, 301; 29/462, 464, 520.1; 156/304.3, 304.5

(56) References Cited

U.S. PATENT DOCUMENTS

| | | | | | |
|---|---|---|---|---|---|
| 820,014 | A | * | 5/1906 | Ries | 249/150 |
| 1,088,060 | A | * | 2/1914 | Carter | 249/17 |
| 1,383,837 | A | * | 7/1921 | Milnes, Jr. | 249/17 |
| 1,539,636 | A | * | 5/1925 | Bitrich | 249/17 |
| 1,591,558 | A | * | 7/1926 | Pike | 249/155 |
| 2,252,539 | A | * | 8/1941 | Adams | 156/212 |
| 2,967,053 | A | * | 1/1961 | Nowak | 269/145 |
| 3,708,930 | A | * | 1/1973 | Stegmeier | 4/506 |
| 3,850,403 | A | * | 11/1974 | Stegmeier | 249/19 |
| 3,904,717 | A | * | 9/1975 | Stegmeier | 249/19 |
| 3,967,422 | A | | 7/1976 | Stegmeier | 52/169 R |
| 4,048,270 | A | * | 9/1977 | Stegmeier | 249/DIG. 3 |
| 4,574,017 | A | | 3/1986 | Stegmeier | 756/60 |
| 4,750,703 | A | * | 6/1988 | Gentilcore et al. | 249/192 |
| 4,887,789 | A | * | 12/1989 | Harris et al. | 249/134 |
| 5,009,047 | A | * | 4/1991 | Olding | 249/17 |
| 5,170,517 | A | | 12/1992 | Stegmeier | 4/496 |
| 5,454,663 | A | | 10/1995 | Stegmeier | 404/2 |
| 5,695,586 | A | | 12/1997 | Stegmeier | 156/245 |

* cited by examiner

*Primary Examiner*—Jan H. Silbaugh
*Assistant Examiner*—Michael I. Poe

(57) ABSTRACT

A crown installation system for forming a crown in place on a pillar in a manner that avoids the need for heavy and complicated concrete form structures. The crown installation system includes a kit for forming a crown on a pillar, such as a chimney, having a perimeter wall with an outer surface and an upper surface converging at an outer upper perimeter edge. The kit includes a plurality of form members, with each form member being adapted for forming a portion of the outer surface of the crown. Each of the form members has opposite ends and an outer face. A plurality of support members are provided for supporting the form members. Each of the support members has a front surface for pressing against a portion of the outer surface of one of the form members. A tension member is provided for holding the support members in position against the form members such that the form members are restricted from outward movement. The invention also includes a method of utilizing the kit to form a crown on a pillar.

21 Claims, 3 Drawing Sheets

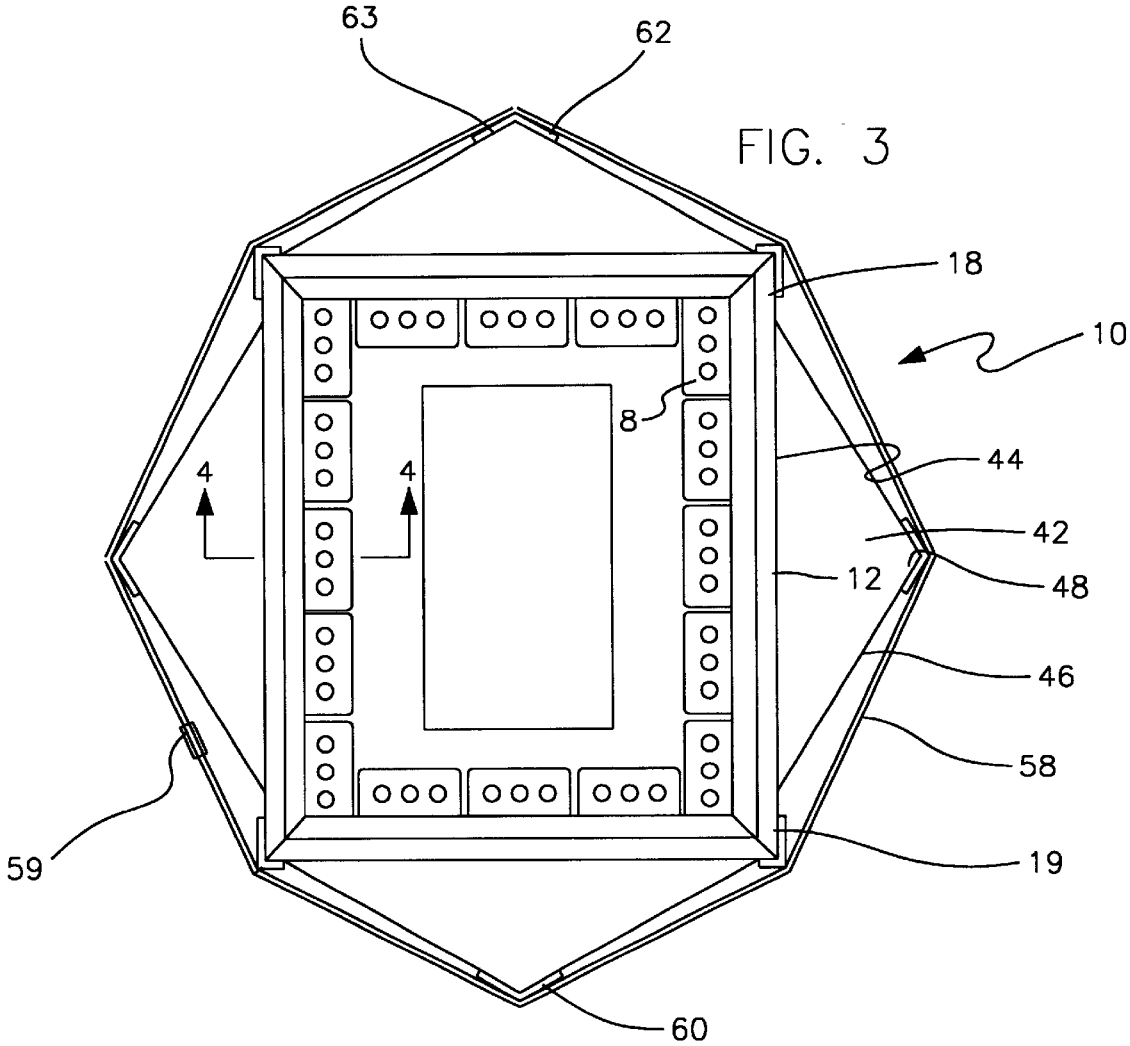
FIG. 3
FIG. 4
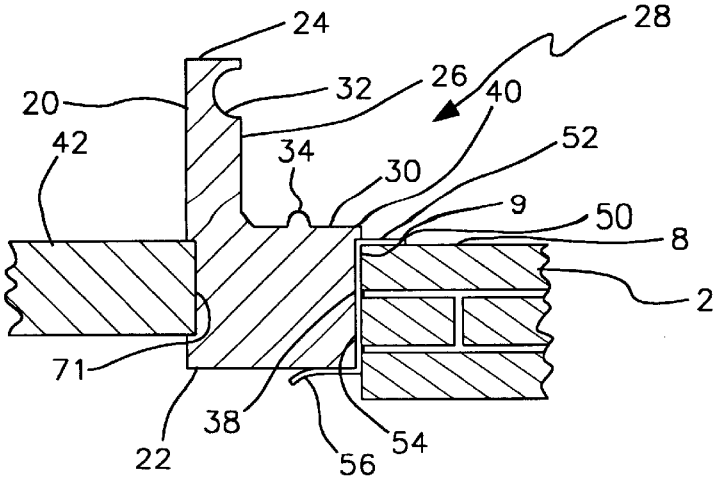

CHIMNEY CROWN INSTALLATION SYSTEM

BACKGROUND OF THE INVENTION

1. Field of the Invention

The present invention relates to crown forming techniques and more particularly pertains to a new crown installation system for forming a crown in place on a pillar (such as a chimney) in a manner that avoids the need for heavy and complicated concrete form structures.

2. Description of the Prior Art

The use of crown forming techniques (such as on chimneys) is known in the prior art. These techniques have typically employed forms made of strong materials capable of containing the relatively heavy cementitious material that forms the crown prior to set of the material. Typically, the known forms comprise wood or metal elements. Some techniques, such as those using wood elements, require that the elements be specially cut to a size suitable for each particular crown forming job. The wood is relatively difficult to cut, which can be dangerous if the assembly is to be done adjacent to a chimney on the roof of the building. Other techniques, such as those using metal elements, may have a measure of adjustability permitting the form to be tailored to the size of each particular crown forming job, and some of the form elements may be reused. Also, these techniques have not generally permitted significant forming of decorative features on the crown, which has meant that the crowns formed with these techniques are typically rather plain. However, one of the biggest drawbacks to these techniques is that the forming elements are bulky and heavy, which make them difficult to use since the form elements must be moved up to the roof of a building, assembled, and then disassembled and removed from the roof of the building.

It has thus been desired in the art to find a crown forming technique, especially for chimneys, that is easier to use in the dangerous elevated environments, such as those encountered on the roofs of buildings, in a manner that is also relatively inexpensive when compared to the conventional crown forming techniques.

In these respects, the crown installation system according to the present invention substantially departs from the conventional concepts and designs of the prior art, and in so doing provides an apparatus primarily developed for the purpose of forming a crown in place on a pillar in a manner that avoids the need for heavy and complicated concrete form structures.

SUMMARY OF THE INVENTION

In view of the foregoing disadvantages inherent in the known types of chimney crown forming techniques now present in the prior art, the present invention provides a new crown installation system construction wherein the same can be utilized for forming a crown in place on a pillar such as a chimney in a manner that avoids the need for heavy and complicated concrete form structures.

The general purpose of the present invention, which will be described subsequently in greater detail, is to provide a new crown installation system apparatus and method which has many of the advantages of the chimney crown forming techniques mentioned heretofore and many novel features that result in a new crown installation system which is not anticipated, rendered obvious, suggested, or even implied by any of the prior art chimney crown forming techniques, either alone or in any combination thereof.

To attain this, the present invention generally comprises a kit for forming a crown on a pillar such as a chimney. The kit includes a plurality of form members, with each form member being adapted for forming a portion of the outer surface of the crown. Each of the form members has opposite ends and an outer face. A plurality of support members are provided for supporting the form members. Each of the support members has a front surface for pressing against a portion of the outer surface of one of the form members. A tension member is provided for holding the support members in position against the form members such that the form members are restricted from outward movement. The invention also includes a method of utilizing the kit to form a crown.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new crown installation system apparatus and method which has many of the advantages of the chimney crown forming techniques mentioned heretofore and many novel features that result in a new crown installation system which is not anticipated, rendered obvious, suggested, or even implied by any of the prior art chimney crown forming techniques, either alone or in any combination thereof.

It is another object of the present invention to provide a new crown installation system which may be easily and efficiently manufactured and marketed.

Yet another object of the present invention is to provide a new crown installation system which provides in the apparatuses and methods of the prior art some of the advantages thereof, while simultaneously overcoming some of the disadvantages normally associated therewith.

Still another object of the present invention is to provide a new crown installation system for forming a crown in place on a pillar in a manner that avoids the need for heavy and complicated concrete form structures.

Yet another object of the present invention is to provide a new crown installation system which includes a kit for forming a crown on a chimney. The kit includes a plurality of form members, with each form member being adapted for forming a portion of the outer surface of the crown. Each of the form members has opposite ends and an outer face. A plurality of support members are provided for supporting the form members. Each of the support members has a front surface for pressing against a portion of the outer surface of one of the form members. A tension member is provided for holding the support members in position against the form members such that the form members are restricted from outward movement. The invention also includes a method of utilizing the kit to form a crown on a chimney.

Still yet another object of the present invention is to provide a new crown installation system that employs a relatively lightweight crown forming structure that is easily transported to and removed from the roof of a structure.

Even still another object of the present invention is to provide a new crown installation system that is relatively easy to assemble in a customized manner for a particular chimney, and can even be assembled on a roof of a structure adjacent to the chimney.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is a schematic top view of the present invention in place on a chimney prior to application of the cementitious material to the form.

FIG. 4 is a schematic sectional view of a portion of the assembled form of the present invention taken along line 4—4 of FIG. 3.

DESCRIPTION OF THE PREFERRED EMBODIMENT

Figure 1:
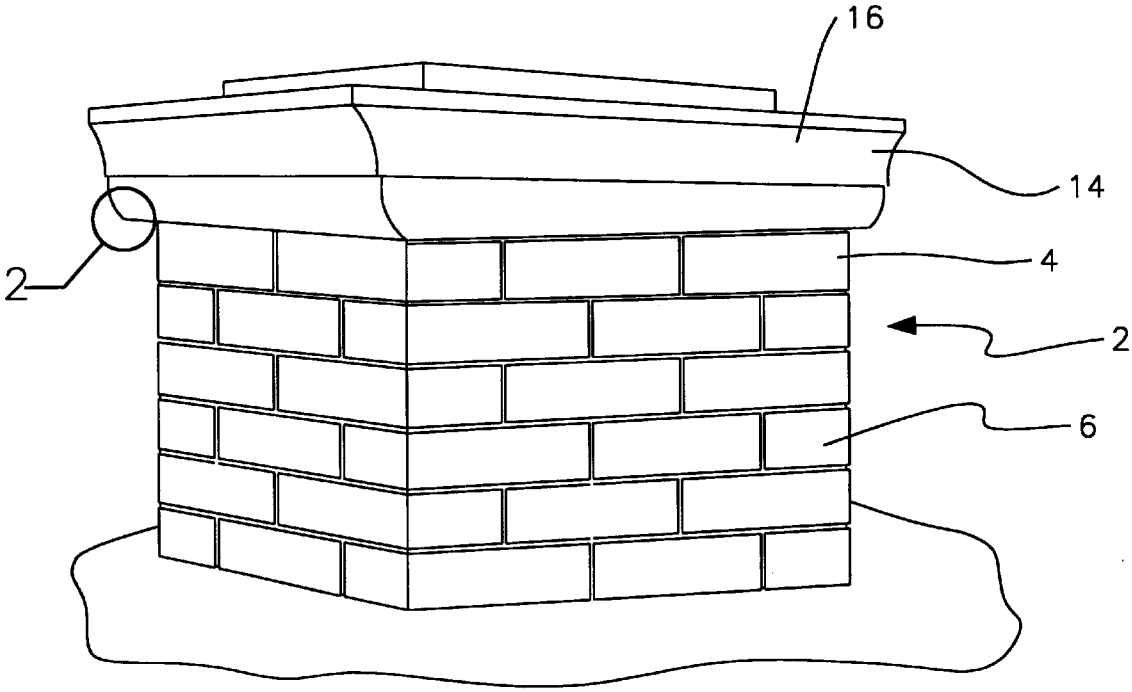
FIG. 1 is a schematic perspective view of a crown on a chimney that may be formed using the apparatus and methods of the present invention.
Figure 2:
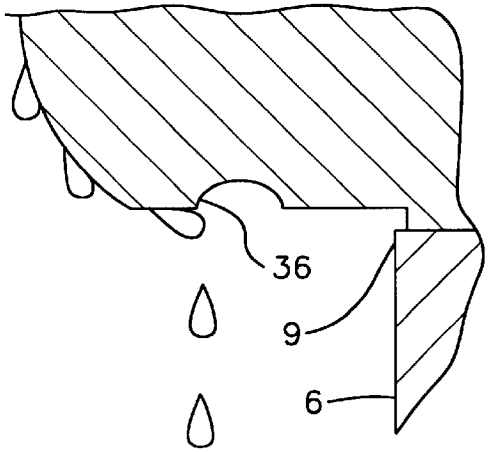
FIG. 2 is a schematic side view of a circled portion of the chimney crown indicated in FIG. 1.
Figure 5:
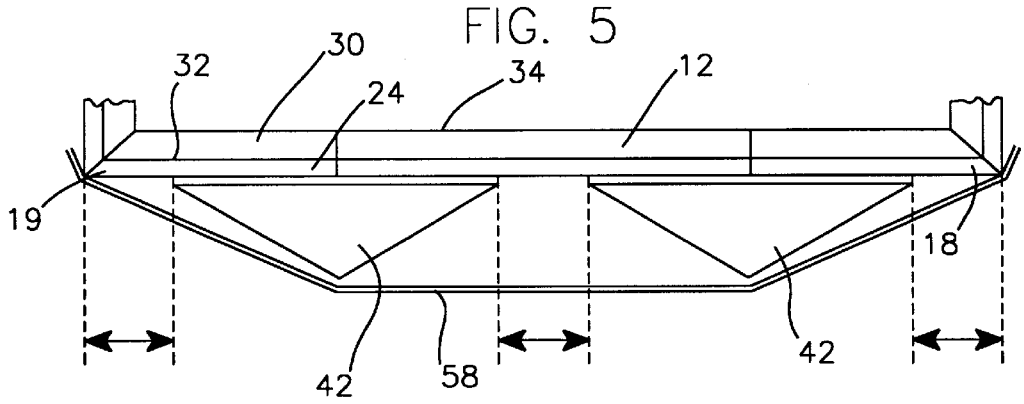
FIG. 5 is a schematic top view of an optional configuration of the present invention particularly illustrating the use of multiple form members and support members on a side of a chimney.

With reference now to the drawings, and in particular to FIGS. 1 through 7 thereof, a new crown installation system embodying the principles and concepts of the present invention and generally designated by the reference numeral 10 will be described.

As best illustrated in FIGS. 1 through 7, the crown installation system 10 generally comprises a kit for forming a crown on a pillar such as a chimney, and a method for forming a crown on a pillar especially employing the kit.

The invention is suitable for forming a crown on a pillar or other upwardly extending element having sides and a top. The invention is especially suitable for forming a crown on a chimney, although a crown may be formed on other pillars, such as columns, using the invention. For description purposes, the invention will be described in the context of forming a crown on a chimney. A suitable chimney 2 for employing the kit and method of the invention has a perimeter wall 4 with an outer surface 6 and an upper surface 8 converging at an outer upper perimeter edge 9.

The kit of the invention includes a plurality of form members 12. Each of the form members 12 is adapted for forming a portion of the outer surface 14 of the crown 16. Each of the form members has opposite ends 18, 19. Each of the form members also has an outer face 20, a lower face 22, an upper face 24, and an inner surface 26. The inner surface 26 of each of the form members has a contoured portion 28 with a bottom forming surface 30 for forming a portion of the bottom of the crown. The contoured portion 28 of the inner surface 26 of each of the form members also has a side forming surface 32 for forming a portion of the outer surface of the crown. In a highly preferred embodiment of the invention, the bottom forming surface 30 of each of the form members has a protrusion 34 extending along a length of the form members for forming a drip edge 36 in the bottom of the crown (see FIG. 2). The contoured portion 28 of the form members may have various shapes for forming various styles of cornices on the outer surface 14 of the chimney crown 16.

The inner surface 26 of the form member has an interface portion 38 for pressing against the outer surface 6 of the chimney 2. Preferably, the inner surface 26 of the form member has a positioning lip 40 extending outwardly from the form member for positioning the form member 12 with respect to the upper surface of the chimney, with the positioning lip being positionable or restable on the outer upper perimeter edge 9 of the chimney. Preferably, each of the form members may be most ideally formed from an expanded rigid polystyrene plastic material, although other lightweight materials may also be used.

The kit also includes a plurality of support members 42 for supporting the form members. Each of the support members has a front surface 44 for pressing against a portion of the outer face 20 of one of the form members, and each of the support members also has a back surface 46. Each of the support members has a substantially triangular shape with the front surface 44 lying along a longest side of the triangle. The back surface 46 of the support member 42 lies along shorter sides of the triangle. A corner 48 lies between the shorter sides, and is adapted for being pressed by the tension member described below. Each of the support members may be most ideally formed from an expanded rigid polystyrene plastic material.

The kit also preferably includes a plurality of support brackets 50 for supporting the form members on the chimney. The support brackets 50 are adapted for positioning on the outer upper perimeter edge 9 of the chimney 2. Each of the support brackets 50 has a first portion 52 for resting on the upper surface of the chimney. A second portion 54 of the support brackets is adapted for positioning adjacent to the outer surface 6 of the chimney. A third portion 56 of the support brackets is adapted for having a portion of one of the form members 12 resting thereon, and is adapted for positioning in an extended orientation from the outer surface 6 of the chimney. In one embodiment of the support bracket, the first portion 52 may be oriented substantially perpendicular to the second portion 54. The third portion 56 may be oriented substantially perpendicular to the second portion 54. The first 52 and third 56 portions may thus be oriented substantially parallel to each other. The most preferred support bracket 50 comprises a wire, such as, for example, an approximately 9 gauge wire. The support brackets 50 are preferably positioned on the chimney with spaces of approximately 16 to 18 inches therebetween.

The kit also includes a tension member 58 for holding the support members in position against the form members. The tension member 58 preferably includes a perimeter band for extending about the form members and support members, and may also include a tensioning device 59 (such as a ratcheting band retraction device) for selectively applying tension to the band Illustratively, the perimeter band may comprise a 1 inch width nylon strap.

The kit may also include corner engaging members 60 for distributing inward pressure from the band to the support members and the form members. Each of the corner engaging members has a first arm 62 and a second arm 63 that intersect at an angle. The corner engaging members 60 may be positioned at the corners at the intersection of the form members for distributing the force of the tension perimeter band and protecting the ends of the form members 12 at places that the band contacts the form members. The corner engaging members 60 may also be positioned on the back surface 46 of the support members. Illustratively, each of the corners engaging members 60 has arms 62, 63 of approximately 3 inches, and the arms have a height of approximately 3 inches.

Figure 7:
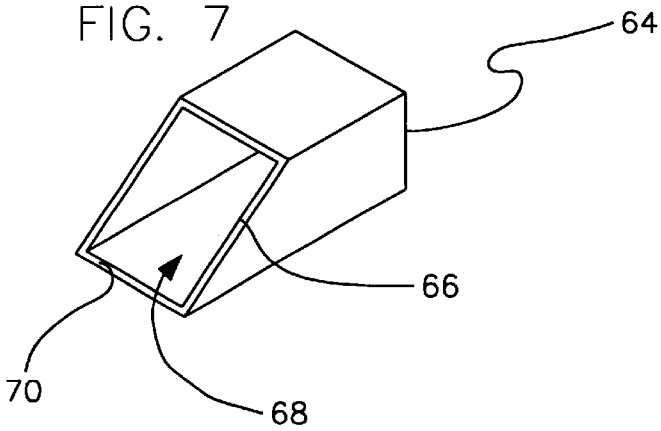
FIG. 7 is a schematic perspective view of a form cutting guide of the invention for facilitating the cutting of the form members.
Figure 6:
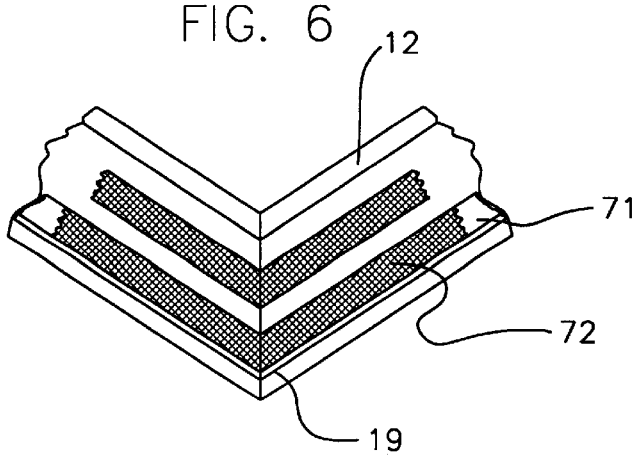
FIG. 6 is a schematic perspective view of an intersection of two of the form members with an adhesive tape securing the end of the form members.

The kit preferably includes a form cutting guide 64 for guiding cutting of the form member (see FIG. 7). The form cutting guide 64 has a perimeter wall 66 defining a lumen 68. The lumen 68 is adapted to receive a portion of one of the form members 12. The lumen 68 has a longitudinal axis, and the form cutting guide 64 has an end perimeter edge 70 lying in a plane oriented at an angle with respect to the longitudinal axis of the lumen 68. Preferably, the angle is approximately 45 degrees for forming a mitered orthogonal corner between the form members.

Preferably, the outer face 20 of each of the form members 12 has a channel 71 for receiving a portion of the support member 42 to secure the position of the support member with respect to the form member. The portion of the support member 42 adjacent the front surface 44 is insertable in the channel 71 for locating and retaining the support member in the proper orientation with respect to the form member 12. Preferably, the channel 71 extends along a length of the form member 12.

The invention further includes a method of forming a crown using the elements of the kit. The dimensions of the outer upper perimeter edge of the chimney are measured, including at least a first dimension of a first edge of the outer upper perimeter edge and a second dimension of a second edge of the outer upper perimeter edge. The second edge extends substantially perpendicular to the first edge. Preferably, the dimensions of each of the sides is measured to account for any irregularities in the lengths of the sides if the outer upper perimeter edge is asymmetrical.

Each of the form members is cut to size for the chimney. A first end of the form member is at approximately 45 degrees to the length of the form member, including inserting the form member into the lumen of the form cutting guide. A second end of the form member is then cut to a length such that the interface portion of the inner face of the form member measures approximately equal to the first dimension. A second one of the form members is cut to the second dimension in a manner similar to the first one. Additional form members may be cut to the first and second dimensions.

The ends of the form members are secured together to form a perimeter form, which in most applications will be rectangular formed by four sides, but could be easily adapted to include forms having three, five, six or more sides depending upon the ultimate shape of the crown to be formed. In one preferred embodiment, a piece of adhesive tape 72 may be applied across adjacent ends of adjacent form members to form a connection therebetween. In one preferred practice of the invention, two pieces of the tape are utilized with one piece being situated in the channel 71.

The support bracket is propped or rested on the chimney adjacent to the outer upper perimeter edge of the chimney. The first portion of the support bracket may be placed on the upper surface of the chimney, and the second portion of the support bracket may be placed against the outer surface of the chimney.

The form members of the perimeter form are rested on the chimney. The positioning lip of the form members is placed on the outer upper perimeter edge of the chimney. Preferably, one of the corner engaging members is positioned against the adjacent ends of the form members of the perimeter form.

In a highly preferred option, the support bracket may be taped or otherwise adhered to the form member at the desired spacing prior to placement of the perimeter form on the outer upper perimeter edge.

The support members are abutted against the form members, preferably by placing the front surface of the support members against the outer face of the form member. A front portion of the support member is inserted into a channel formed on the outer face of the form member. Preferably, one of the corner engaging members is positioned against the back surface of the support members.

On relatively shorter lengths of the form members, a single support member may be used (see FIG. 3). On relatively longer lengths of the form members, two or more support members may be positioned along the form member on one side of the perimeter form (see FIG. 5). Ideally, multiple support members should be spaced substantially uniformly apart on a side of the perimeter form. On perimeter forms having relatively long sides, multiple form member pieces may be used and may be attached using, for example, pieces of adhesive tape. Crowns with sides as long as 96 inches or more may be formed using multiple form member pieces and multiple support members. Preferably, the support members are positioned such that the connections between the form member pieces are located along the front surface of one of the support members.

The tension member is extended about the support members and the perimeter form for pressing the support members inward against the form members of the perimeter form. Preferably, the perimeter band is extended about the support members and engages the back surface of the support members, and may engage the corners of the perimeter form for providing additional support.

A form release agent may be applied to the inner surface of the form members for facilitating separation of the form members from the formed cementitious material after the material has set up.

A cementitious material is poured into an interior of the perimeter form and onto the upper surface of the chimney. After the cementitious material has set up, the form members may be pulled away from the chimney crown. The form members may be discarded, while the rest of the kit may be reused on subsequent crown constructions. It has been observed that with careful removal techniques, the form members can be used two or even more times before the form member is too worn to reuse.

In one illustrative embodiment, the outer face of the form members has a width of approximately 6½ inches, and the lower face has a width of approximately 3½ inches. The upper face has a width of approximately 1½ inches. The contoured portion of the inner surface has a bottom forming surface with a width of approximately 2⅜ inches, and a side forming surface with a width of approximately ⅜ inches. The positioning lip has a width of approximately ⅜ inch, and protrudes approximately ¼ inch from the interface surface, which has a width of approximately 2½ inches. It will be realized that these illustrative dimensions are approximate, and may be varied, for example, to achieve various shapes for the sides of the crown molding to be formed.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A method of constructing a form for forming a crown on a pillar having a perimeter wall with an outer surface and an upper surface converging at an outer upper perimeter edge, comprising:

providing a crown forming assembly, the crown forming assembly comprising:

a plurality of form members, each of the form members being adapted for forming a portion of the outer surface of the crown, each of the form members having opposite ends, each of the form members having an outer face;

a plurality of support members for supporting the form members, each of the support members having a front surface for pressing against a portion of the outer surface of one of the form members;

a tension member for holding the support members in position against the form members, the tension member comprising a perimeter band for extending about the form members and support members and comprising a plurality of corner engaging members;

forming the form members into a perimeter form having corners formed by ends of the form members;

resting the form members of the perimeter form on the pillar;

abutting the support members against the form members, placing a front surface of the support members against the outer face of the form member;

extending the tension member about the support members and the perimeter form; and applying tension to the tension member to press inwardly on the corners of the perimeter form and on the support members via the corner engaging members such that the support members press inwardly against the form members of the perimeter form.

2. The method of claim 1 additionally comprising securing the ends of the form members together to form a perimeter form, wherein securing includes applying a piece of adhesive tape across adjacent ends of adjacent form members.

3. The method of claim 1 wherein each of the form members is elongate between the opposite ends, and wherein the outer face of each of the form members has a channel extending longitudinally between the opposite ends thereof for receiving a portion of one of the support members for securing the position of the support member with respect to the associated form member, and additionally comprising inserting a front portion of the support member into a channel formed on the outer face of the associated form member.

4. The method of claim 1 additionally comprising:

providing the corner engaging members to distribute inward pressure from the band to the support members and the form members, each of the corner engaging members having a bend formed therein such that a first portion of the corner engaging member is angled with respect to a second portion of the corner engaging member;

positioning one of the corner engaging members against the adjacent ends of the form members forming one of the corners of the perimeter form; and positioning another of the corner engaging members against the back surface of one of the support members.

5. The method of claim 1 wherein the form members are elongate and the support members are elongate, a longitudinal axis of the support members being oriented substantially parallel to a longitudinal axis of the form members.

6. The method of claim 1 additionally comprising providing a plurality of support brackets for supporting the form members on the pillar, the support brackets being adapted for positioning on the outer upper perimeter edge, each of the support brackets having a first portion for resting on the upper surface, a second portion for positioning adjacent to the outer surface, and a third portion for having a portion of one of the form members resting thereon, the third portion being for adapted for positioning in an extended orientation from the outer surface, and propping one of the support brackets on the pillar adjacent to the outer upper perimeter edge, placing the first portion of the support bracket on the upper surface, and placing the second portion of the support bracket against the outer surface.

7. The method of claim 6 additionally comprising forming the support brackets from a wire.

8. The method of claim 1 additionally comprising providing the support members with a substantially triangular shape, and pressing the tension member against an apex of the substantially triangular shape of the support members via the corner engaging members.

9. The method of claim 8 additionally comprising positioning a long side of the substantially triangular shape of the support members against the form members.

10. The method of claim 1 additionally comprising cutting each of the form members to size for the pillar.

11. The method of claim 10 wherein the act of cutting the form members includes providing a form cutting guide for guiding cutting of each of the form members, the form cutting guide having a perimeter wall defining a lumen, the lumen being adapted to receive a portion of the form member, the lumen having a longitudinal axis, the form cutting guide having an end perimeter edge lying in a plane oriented at an angle with respect to the longitudinal axis of the lumen, wherein the angle is approximately 45 degrees.

12. The method of claim 11 additionally comprising measuring the dimensions of each linear edge portion of the outer upper perimeter edge including a first dimension of a first edge portion of the outer upper perimeter edge and a second dimension of a second edge portion of the upper outer perimeter edge.

13. The method of claim 12 additionally comprising inserting the one of form members into the lumen of the form cutting guide, cutting a first end of the form member at an angle of approximately 45 degrees to the length of the form member, cutting a second end of the form member such that the interface portion of the inner face of the form member measures approximately equal to the first dimension, and repeating the cutting on a second one of the form members to the second dimension.

14. A method of forming a crown on a pillar having a perimeter wall with an outer surface and an upper surface converging at an outer upper perimeter edge, comprising:

providing a crown forming assembly, the crown forming assembly comprising:

a plurality of form members, each of the form members being adapted for forming a portion of the outer surface of the crown, each of the form members having opposite ends, each of the form members having an outer face;

a plurality of support members for supporting the form members, each of the support members having a front surface for pressing against a portion of the outer surface of one of the form members;

a tension member for holding the support members in position against the form members, the tension member comprising a perimeter band for extending about the form members and support members and comprising a plurality of corner engaging members;

forming the form members into a perimeter form;

resting the form members of the perimeter form on the pillar;

abutting the support members against the form members, placing a front surface of the support members against the outer face of the form member;

extending the tension member about the support members and the perimeter form and applying tension to the tension member to press inwardly on corners of the perimeter form and on the support members via the corner engaging members such that the support members press inward against the form members of the perimeter form;

pouring material into an interior of the perimeter form and on the upper surface of the perimeter wall to form a crown; and removing the perimeter form from the crown.

15. The method of claim 14 additionally comprising:

providing a plurality of support brackets for supporting the form members on the pillar, each of the support brackets having a first portion for resting on the upper surface, a second portion for positioning adjacent to the outer surface, and a third portion for having a portion of one of the form members resting thereon;

propping one of the support brackets on the pillar adjacent to the outer upper perimeter edge by placing the first portion of the support bracket on the upper surface and placing the second portion of the support bracket against the outer surface; and removing the support brackets from the pillar after removing the perimeter form from the pillar.

16. The method of claim 14 additionally comprising applying a piece of adhesive tape across adjacent ends of adjacent form members to secure the ends of the form members together.

17. The method of claim 14 wherein each of the form members is elongate between the opposite ends, and wherein the outer face of each of the form members has a channel extending longitudinally between the opposite ends thereof for receiving a portion of one of the support members for securing the position of the support member with respect to the associated form member, and additionally comprising inserting a front portion of the support member into a channel formed on the outer face of the associated form member.

18. The method of claim 14 additionally comprising:

providing the corner engaging members to distribute inward pressure from the band to the support members and the form members, each of the corner engaging members having a bend formed therein such that a first portion of the corner engaging member is angled with respect to a second portion of the corner engaging member;

positioning one of the corner engaging members against the adjacent ends of the form members forming one of the corners of the perimeter form; and positioning another of the corner engaging members against the back surface of one of the support members.

19. The method of claim 14 additionally comprising forming a groove on an underside surface of the crown to provide a drip edge at which water moving along the underside surface is separated from the underside surface by gravity.

20. The method of claim 19 wherein forming a groove on the underside of the crown includes providing the form members with a longitudinally extending protrusion on a bottom forming surface of the form members.

21. A method of forming a crown on a pillar having a perimeter wall with an outer surface and an upper surface converging at an outer upper perimeter edge, comprising:

providing a crown forming assembly, the crown forming assembly comprising:

a plurality of form members, each of the form members being adapted for forming a portion of the outer surface of the crown, each of the form members having opposite ends, each of the form members having an outer face;

a plurality of support members for supporting the form members, each of the support members having a front surface for pressing against a portion of the outer surface of one of the form members, the support members having a substantially triangular shape;

a tension member for holding the support members in position against the form members, the tension member comprising a perimeter band for extending about the form members and support members;

forming the form members into a perimeter form;

applying a piece of adhesive tape across adjacent ends of adjacent form members to secure the ends of the form members together while resting the form members of the perimeter form on the pillar;

providing a plurality of support brackets for supporting the form members on the pillar, each of the support brackets having a first portion for resting on the upper surface, a second portion for positioning adjacent to the outer surface, and a third portion for having a portion of one of the form members resting thereon;

propping one of the support brackets on the pillar adjacent to the outer upper perimeter edge by placing the first portion of the support bracket on the upper surface and placing the second portion of the support bracket against the outer surface;

providing corner engaging members for distributing inward pressure from the band to the support members and the form members, each of the corner engaging members having a bend formed therein such that a first portion of the corner engaging member is angled with respect to a second portion of the corner engaging member;

positioning one of the corner engaging members against the adjacent ends of the form members forming one of the corners of the perimeter form; and positioning another of the corner engaging members against the back surface of one of the support members;

abutting the support members against the form members, placing a front surface of the support members against the outer face of the form members including positioning a long side of the substantially triangular shape of the support members against the form members;

extending the tension member about the support members and the perimeter form to press the support members inward against the form members of the perimeter form;

pressing the tension member against an apex of the substantially triangular shape of the support members;

pouring material into an interior of the perimeter form and on the upper surface of the perimeter wall to form a crown; and removing the perimeter form from the crown;

removing the support bracket from the pillar after removing the perimeter form from the pillar.

* * * * *